US005421518A

United States Patent [19]

Robisch et al.

[11] Patent Number: 5,421,518

[45] Date of Patent: Jun. 6, 1995

[54] AIRBRUSH WITH DETACHABLE REGULATING TIP

[75] Inventors: Herman Robisch, Schiller Park; Walter Schlotfeldt, Bartlett, both of Ill.

[73] Assignee: Badger Air Brush Co., Franklin Park, Ill.

[21] Appl. No.: 153,996

[22] Filed: Nov. 18, 1993

[51] Int. Cl.[6] ..... B05B 7/04; B05B 7/24

[52] U.S. Cl. ..... 239/311; 239/340; 239/375; 239/407; 239/525

[58] Field of Search ..... 239/311, 340, 390, 391, 239/407, 417.3, 417.5, 434.5, 525, 526, 530, 538, 539, 375, 600; D23/213, 223, 225, 226, 229

[56] References Cited

U.S. PATENT DOCUMENTS

| | | | |
|---|---|---|---|
| 1,703,359 | 2/1929 | Paasche | 239/375 X |
| 2,059,706 | 11/1936 | Paashe | 239/526 X |
| 2,721,763 | 10/1955 | Miner | 239/375 X |
| 3,168,250 | 2/1965 | Paasche | 239/300 |
| 4,171,097 | 10/1979 | Rebold | 239/417.3 X |
| 4,572,438 | 2/1986 | Traylor | 239/600 X |

FOREIGN PATENT DOCUMENTS 70254 11/1945 Denmark ..... 239/417.3

OTHER PUBLICATIONS

Badger Air Brush Flyer given at Trade Show.
Badger Air Brush Crescendo Model 175 Brochure.
Bonny Airbrush brochure; no date, but received by office May 30, 1989.

*Primary Examiner*—Andres Kashnikow
*Assistant Examiner*—Lesley D. Morris
*Attorney, Agent, or Firm*—Gerstman, Ellis & McMillin, Ltd.

[57] ABSTRACT

An airbrush which comprises a front body through which air and paint are directed is provided. A head, having a tube known as a post, is removably attached to the front body. A paint tip and a regulator, removably attached to the head, are also provided. The regulator comprises a detachable holding ring and a regulating tip. The paint tip is secured to the head by the holding ring when the paint tip is placed within the post and the holding ring is attached to the head. The regulating tip can be detached from the airbrush while the paint tip remains secured by the holding ring. The head, paint tip and regulator, comprising a crown, are interchangeable with other crowns.

13 Claims, 2 Drawing Sheets

Fig. 1
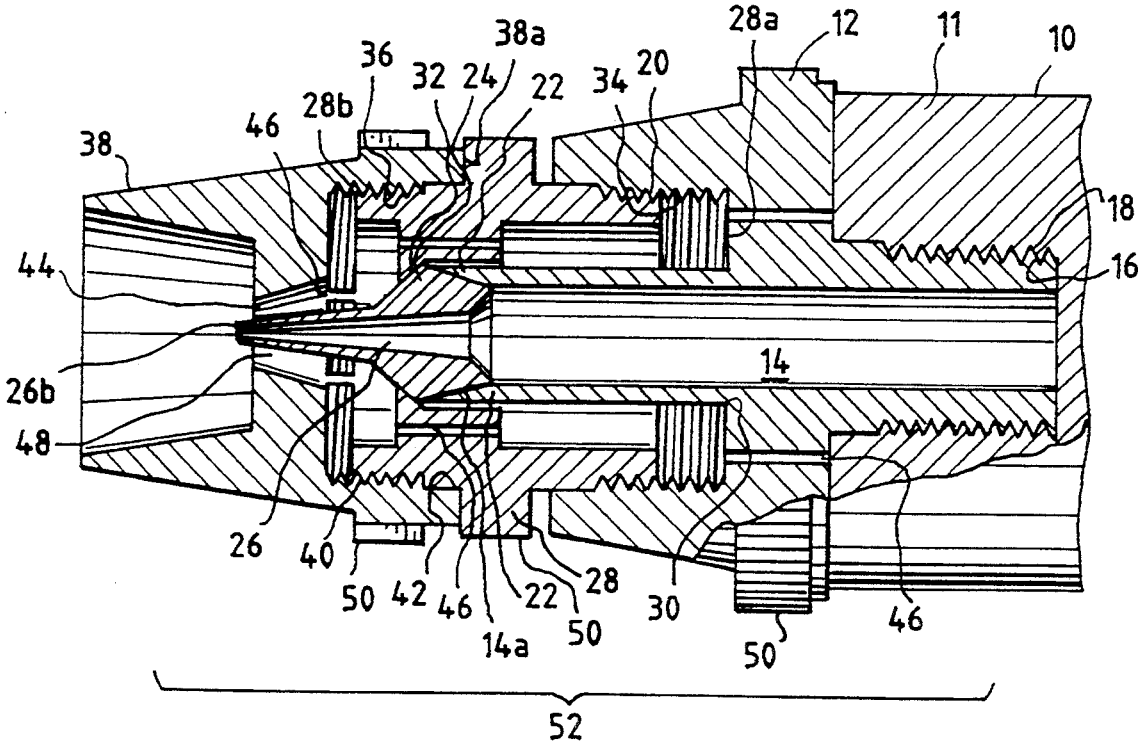
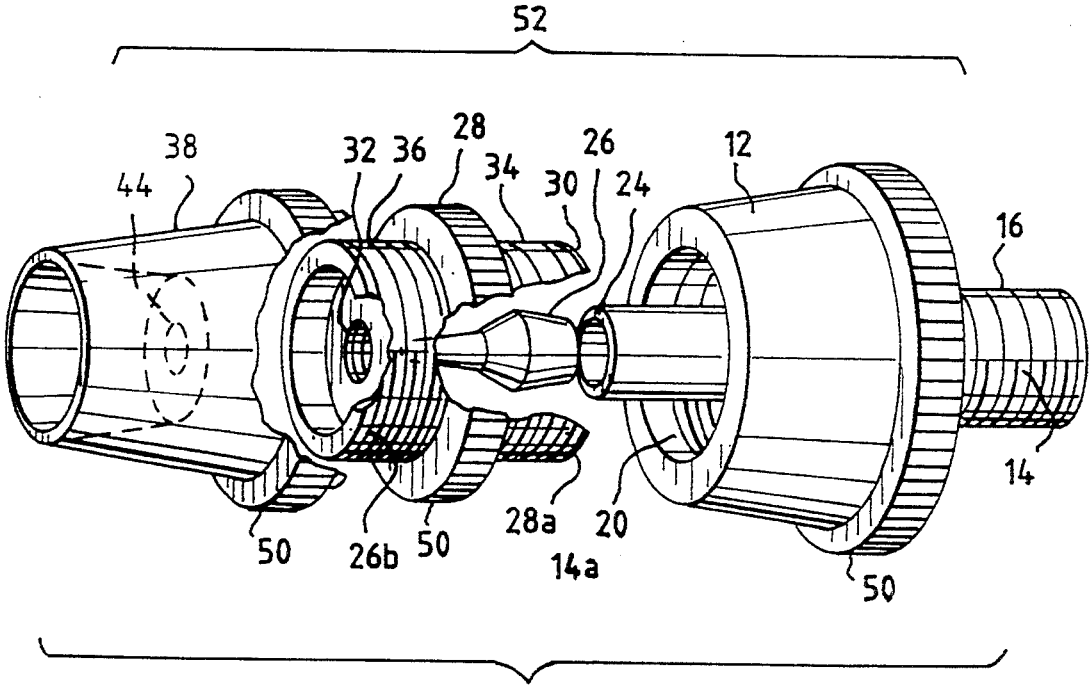
Fig. 2

AIRBRUSH WITH DETACHABLE REGULATING TIP

FIELD OF THE INVENTION

The present invention concerns a novel airbrush with a detachable regulating tip.

BACKGROUND OF THE INVENTION

Small airbrushes are ideally suited for precision painting and other artistic endeavors. The small size and light weight of the equipment allows ease in holding and longer use before fatiguing the user's hand. However, as a result of the small size needed, the airbrush, which includes a large number of very small precision parts, is generally difficult to manufacture and assemble, and is also difficult to disassemble for cleaning.

In many prior art air brushes the most precise and tiny parts are found in the crown. The crown comprises a head with a post connecting the head to the front body, a paint tip and a regulator. The post comprises a tube through which the paint needle and paint pass in the head. The paint tip, a tiny and highly specialized part, is screwed into the post and accepts a paint regulating needle. The paint tip comprises the final passage for paint prior to the mixing of the paint and air. In many prior art airbrushes, the paint tip is constructed with threads so that it can be screwed into the distal end of the post. The assembly of the paint tip to the airbrush head, via the post, further required the use of beeswax. The beeswax was heated and applied by a skilled technician to the threads of the paint tip so as to form a leak-proof seal of the walls of the post and the paint tip when the threads of the paint tip and post were inter-engaged. The head and paint tip assembly would then be attached to the front body of the airbrush.

In order to clean thoroughly an airbrush constructed in this manner, the user would have to break the seal between the paint tip and the head, clean the parts and then reassemble the parts in the manner described above. Many users, without the materials, tools or skills to do this operation, were forced to return the paint tip and head assembly. This generally caused the user to be without the use of the airbrush for a considerable amount of time or necessitated the purchase of replacement interchangeable paint tip and head assemblies.

Further, in many of the prior art small airbrushes, the assembly of the remaining parts of the crown about the delicate paint tip and post assembly often caused the elongated paint tip and post assembly to be bent or broken. For example, the incorrect placement of a regulator during assembly could cause the paint tip to apply pressure to the post, bending the post or taking the paint tip and post assembly out of alignment. Because the alignment of the paint tip to the orifice of the regulator is critical to the operation of the airbrush, such misalignment is fatal to an airbrush.

In many larger model airbrushes, such as the CRESCENDO TM 175T airbrush by Badger Air-Brush Co. of Franklin Park, Ill., this problem is obviated by the increased size of the device. In the CRESCENDO T-M airbrush, the paint tip is seated in the airbrush body and a head is attached to the body. The paint tip emerges through the head and is held to the airbrush body by the head. A regulator is then attached to the head. This three part system, paint tip, head and regulator, works well in larger air brushes.

One solution to the problem posed by the small airbrush was to devise a paint tip without threads for use with crown components that would be interchangeable on prior art airbrush front bodies. This was accomplished by Badger Air-Brush Co. in 1992. In the Badger airbrush, a head with a post defined therethrough was attached to the airbrush body. The proximal end of the post of the head connected the head to the paint supply of the airbrush and allowed, at the distal end of the post, the seating of a paint tip. The distal end of the post of the head was shaped to accept a paint tip in such a way that post and paint tip conformed to each other to allow an almost leak proof coupling without the use of beeswax. A regulator was then attached to hold the paint tip to the head. This design formed a three part system: head, paint tip and regulator.

However, because of the small size of the airbrushes, the regulators, which are concomitantly small, often became clogged during a painting project. The user must then stop and clean the regulator to unclog the tiny passages or replace the crown. It has been discovered that when the regulator is removed from these prior art Badger airbrushes to remove a clog, the paint tip no longer is held in place and may fall out of the head. This might result in the loss of the tiny paint tip and paint to spill from the airbrush. As the need to unclog the regulator is relatively frequent in the use of small airbrushes, this three part system, although solving many of the problems of the prior-art airbrushes, has disadvantages.

We have discovered a novel four-part small airbrush that obviates the need for skilled re-assembly, sealing compounds or large sized parts and allows the use of a non-threaded paint tip that will not fall out when the regulating tip is removed for cleaning. We have also discovered that this four-part system can be substituted onto many prior art airbrush front bodies and handles thereby obviating the need for present airbrush users to purchase entirely new airbrushes. The substitution would give the user all of the benefits of the prior art airbrushes and provide all of the benefits described herein. Further, because the paint tip and the post, of the present invention, are not fixed together, better alignment between the paint tip and the regulating tip can be achieved and fewer posts may be bent or otherwise taken out of alignment.

It is therefore an object of the present invention to provide a small airbrush that is easy to manufacture and assemble.

It is another object of the present invention to provide a small airbrush that can be easily taken apart for cleaning and that can be easily reassembled.

It is another object of the present invention to provide a small airbrush that has a regulating tip that can be removed for cleaning without the loss of the paint tip or the spilling of paint or the misalignment of parts upon reassembly.

It is a further object of the present invention to provide a four-part crown that can be readily interchanged with prior art crowns.

Other objects and advantages of the present invention will become apparent as the description proceeds.

SUMMARY OF THE INVENTION

In accordance with the present invention, an airbrush which comprises a front body through which air and paint are directed is provided. A head, having a tube known as a post, is removably attached to the front body. A paint tip and a regulator, removably attached to the head, are also provided. The regulator comprises a detachable holding ring and a regulating tip.

The paint tip is secured to the head by the holding ring when the paint tip is placed within the post and the holding ring is attached to the head. The regulating tip can be detached from the airbrush while the paint tip remains secured by the holding ring.

In the illustrative example, the paint tip and post are shaped so that their joinder produces a close fit. In this way, when pressure is applied through the holding ring, leakage of paint is minimized. Further, the illustrative example shows a crown design that can be used on prior art airbrushes, allowing the user to buy a replacement crown kit and obviating the need for the user to buy an entirely new airbrush.

A more detailed explanation of the invention is provided in the following description and claims and is illustrated in the accompanying drawings.

BRIEF DESCRIPTION OF THE DRAWINGS

FIG. 1 is an elevational cross section of an airbrush of the present invention.

FIG. 2 is an exploded perspective view, partially cut away, of the airbrush of the present invention.

DETAILED DESCRIPTION OF THE ILLUSTRATIVE EMBODIMENT

Figure 3:
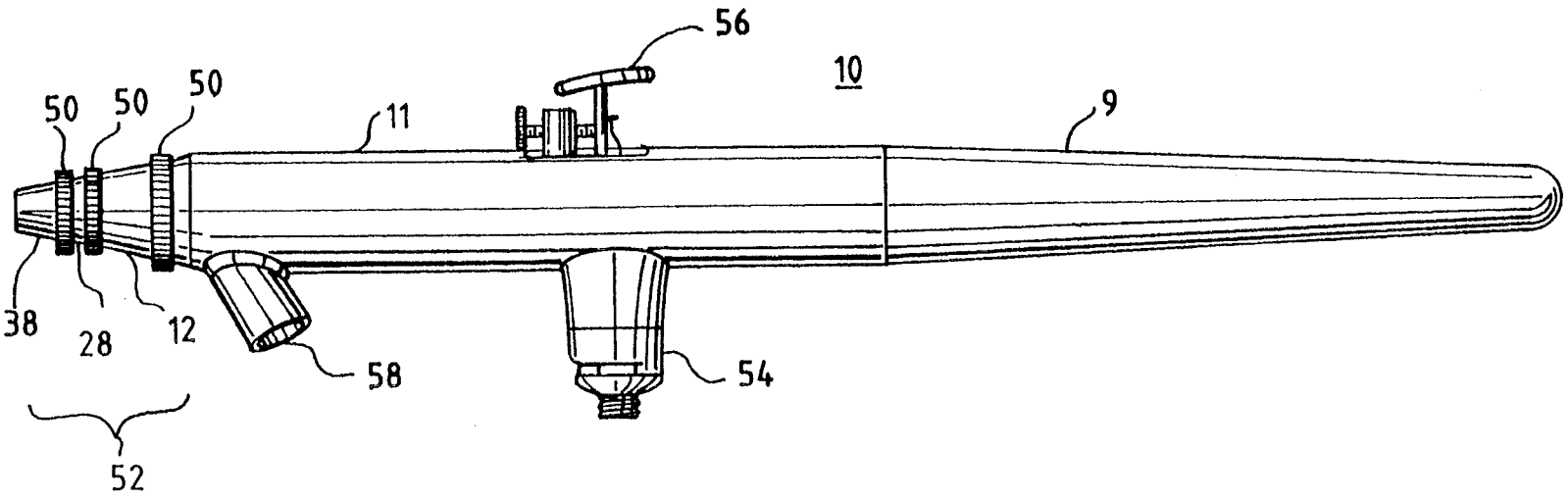
FIG. 3 is a perspective view of an airbrush of the present invention.

Referring to the drawings, FIG. 1 shows an airbrush 10 having a front body 11 and a head 12. Head 12 defines a tube known as post 14 therethrough. Post 14 defines threads 16 which are threadingly engaged to internal threads 18 of front body 11, removably attaching head 12 to front body 11. Head 12 further defines internal threads 20.

Post 14 defines walls 22 which taper internally to form a thin ring 24 at post distal end 14*a*. A paint tip 26 is provided and is shaped to fit within post distal end 14*a*, forming a seal between paint tip 26 and post 14.

A holding ring 28 defining a first opening 30 at its proximal end 28*a* and a second opening 32 is provided. External threads 34 are provided on proximal end 28*a* and external threads 36 are provided on distal end 28b of holding ring 28. External threads 34 of holding ring 28 threadingly engage internal threads 20 of head 12 when paint tip 26 is seated in post 14. Distal end 26*b* of paint tip 26 emerges through second opening 32 of holding ring 28 when holding ring 28 is so engaged with head 12. Holding ring 28 engages paint tip 26 at second opening 32 holding paint tip 26 within post 14.

Regulating tip 38, having internal threads 40, and defining a first opening 42 at its proximal end 38*a* and a second opening 44, is also provided. Regulating tip 38 is threadingly engaged to holding ring 28 by external threads 36 of holding ring 28 and internal threads 40 of regulating tip 38. Paint tip 26 passes through second opening 44 of regulating tip 38, when regulating tip 38 is threadingly engaged to holding ring 28. FIG. 2 shows the relationship of the head 12, holding ring 28 and regulating tip 38, together defining the crown 52. FIG. 3 shows the relationship of the crown 52 to the front body 11 and handle 9 of the airbrush 10.

In the operation of airbrush 10, a source of pressurized air is connected to air intake valve assembly 54. Trigger assembly 56 is depressed and paint enters a central cavity, which is connected to post 14, from paint intake assembly 58, and pressurized air enters air channel 46. The pressurized air travels through air passages 46 to air cavity 48 where the pressurized air surrounds paint tip 26, is propelled through opening 44 and draws paint through paint tip 26. The air and paint are mixed and are propelled onto the surface to be painted.

After the painting is completed, or if regulating tip 38 becomes clogged, the user may unscrew regulating tip 38 for cleaning. Holding ring 28 is maintained in position to hold paint tip 26 in place on post 14. In this way cleaning or unclogging is achieved without paint dripping from post 14. Further, paint tip 26 is not released and therefore, the chances of paint tip 26 being lost are minimized. Knurled rings 50 are provided to facilitate the assembly and disassembly of head 12, holding ring 28 and regulating tip 38. Crown 52 can be replaced by other crowns, of different sizes or for different applications, and can be used to replace prior art crowns (not shown) on prior art airbrushes. Further, the assembly of paint tip 26 and head 12 can be replaced by head and paint tip assemblies of different sizes or for different applications.

Although an illustrative embodiment of the invention has been shown and described, it is to be understood that various modifications and substitutions may be made by those skilled in the art without departing from the novel spirit and scope of the invention.

What is claimed is:

1. An airbrush which comprises:

a front body through which air and paint are directed;

a head, comprising a tube, removably attached to said front body;

a paint tip;

a regulator, removably attached to said head, said regulator comprising a detachable holding ring and a regulating tip;

said holding ring defining at least one opening through which air may pass;

said paint tip being secured to said head by said holding ring when said paint tip is placed within said tube and said holding ring is attached to said head;

said regulating tip being detachable while said paint tip remains secured by said holding ring.

2. The airbrush of claim 1, wherein said paint tip has a tapered seating end and said tube is shaped to conform to said tapered seating end so as to provide a secure fit when said paint tip is seated in said tube.

3. The airbrush of claim 1, wherein said head, holding ring and regulating tip each have a knurled ring about their exterior surfaces so as to aid in assembly and disassembly.

4. The airbrush of claim 1, wherein said head, holding ring and regulating tip are threaded so as to screw together.

5. The airbrush of claim 1, wherein said paint tip is not fixedly attached to said tube.

6. The airbrush of claim 1 in which said head, paint tip, holding ring and regulating tip comprise a crown, said crown being interchangeable with other crowns.

7. An airbrush which comprises:

a front body through which air and paint are directed;

a head, comprising a tube, removably attached to said front body, said tube having a distal end;

a paint tip, tapered to conform to the shape of said distal end of said tube;

a regulator, removably attached to said head, said regulator comprising a detachable holding ring and a regulating tip;

said holding ring defining at least one opening through which air may pass;

said paint tip being secured to said head by said holding ring when said paint tip is placed within said tube and said holding ring is attached to said head;

said regulating tip being detachable while said paint tip remains secured by said holding ring; and said head, holding ring and regulating tip each having a knurled ring about its exterior for aid in assembly and disassembly.

8. The airbrush of claim 7, wherein said removable attachments are made by threadings and said head, holding ring and regulating tip are screwed together for assembly and un-screwed for disassembly.

9. An airbrush crown which comprises:

a head defining a tube;

a paint tip shaped to sealingly sit within said tube;

a holding ring and a regulating tip removably attached to said head;

said holding ring defining at least one opening through which air may pass;

said crown being interchangeably attachable to an airbrush.

10. The airbrush crown of claim 9, wherein said head, holding ring and regulating tip each having a knurled ring about its exterior for aid in assembly and disassembly.

11. The airbrush of claim 9, wherein said head, holding ring and regulating tip are threaded so as to screw together.

12. The airbrush of claim 9, wherein said paint tip is not fixedly attached to said tube.

13. An airbrush crown which comprises:

a head, comprising a tube having a distal end;

a paint tip, tapered to conform to the shape of said distal end of said tube;

a regulator, removably attached to said head, said regulator comprising a detachable holding ring and a regulating tip;

said holding ring defining at least one opening through which air may pass;

said paint tip being secured to said head by said holding ring when said paint tip is placed within said tube and said holding ring is attached to said head;

said regulating tip being detachable while said paint tip remains secured by said holding ring;

said head, holding ring and regulating tip each having a knurled ring about its exterior for aid in assembly and disassembly;

said airbrush crown being interchangeably attachable to an airbrush.

* * * * *